US011193373B2

(12) United States Patent
Hsu et al.

(10) Patent No.: US 11,193,373 B2
(45) Date of Patent: Dec. 7, 2021

(54) PREDICTION OF SATURATION PRESSURE OF FLUID

(71) Applicant: Schlumberger Technology Corporation, Sugar Land, TX (US)

(72) Inventors: Kai Hsu, Sugar Land, TX (US); Elizabeth Jennings Smythe, Cambridge, MA (US); Matthew Sullivan, Westwood, MA (US); Christopher Harrison, Auburndale, MA (US); Hua Chen, Yokohama (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 336 days.

(21) Appl. No.: 15/624,735

(22) Filed: Jun. 16, 2017

(65) Prior Publication Data

US 2017/0370215 A1 Dec. 28, 2017

Related U.S. Application Data

(60) Provisional application No. 62/354,987, filed on Jun. 27, 2016.

(51) Int. Cl.

| | |
|---|---|
| ***E21B 49/08*** | (2006.01) |
| ***E21B 47/06*** | (2012.01) |
| ***E21B 49/10*** | (2006.01) |
| ***E21B 47/07*** | (2012.01) |

(52) U.S. Cl.

CPC ..... *E21B 49/088* (2013.01); *E21B 47/06* (2013.01); *E21B 47/07* (2020.05); *E21B 49/082* (2013.01); *E21B 49/10* (2013.01); *E21B 49/0875* (2020.05)

(58) Field of Classification Search

CPC .... E21B 49/082; E21B 49/088; E21B 47/065; E21B 49/10; E21B 47/06; E21B 2049/085

See application file for complete search history.

(56) References Cited

U.S. PATENT DOCUMENTS

| | | | | |
|---|---|---|---|---|
| 7,423,930 | B2 | 9/2008 | Valero et al. | |
| 2004/0231408 | A1 * | 11/2004 | Shammai | E21B 49/10 73/152.27 |
| 2006/0016594 | A1 * | 1/2006 | Krueger | E21B 49/008 166/250.07 |
| 2010/0154529 | A1 * | 6/2010 | Terabayashi | E21B 49/10 73/152.27 |

(Continued)

OTHER PUBLICATIONS

E. Milan Arcia et al., "Estimation of Saturation Pressure Through Wellbore Measurements", SPE 90186, SPE Annual Technical Conference and Exhibition, Houston, TX, USA, Sep. 26-29, 2004, 7 pages.*

*Primary Examiner* — Alexander Satanovsky
(74) *Attorney, Agent, or Firm* — Trevor G. Grove

(57) ABSTRACT

Apparatus and methods for obtaining a data response of a fluid as a function of pressure of the fluid, and estimating a dew point pressure of the fluid by detecting an inflection pressure, a downward curve pressure, a characteristic change pressure, and an intersection pressure of the function representative of the data response. The estimated dew point pressure of the fluid based on at least one of the inflection pressure, the downward curve pressure, the characteristic change pressure, and the intersection pressure.

19 Claims, 9 Drawing Sheets

(56) References Cited

U.S. PATENT DOCUMENTS

2014/0320859 A1* 10/2014 Thennadil ..... G01N 21/0303
356/432
2016/0193375 A1* 7/2016 Laflamme ..... A61L 2/24
422/33

* cited by examiner

PREDICTION OF SATURATION PRESSURE OF FLUID

CROSS-REFERENCE TO RELATED APPLICATIONS

This application claims the benefit of U.S. Provisional Application Ser. No. 62/354,987, filed on Jun. 27, 2016, the entire contents of which are hereby incorporated by reference into the current application.

BACKGROUND OF THE DISCLOSURE

In order to successfully exploit subterranean hydrocarbon reserves, information about the subterranean formations and formation fluids intercepted by a wellbore is acquired. This information may be acquired via sampling formation fluids during various drilling and/or testing operations. The fluid may be collected and analyzed, for example, to ascertain composition and production characteristics of hydrocarbon fluid reservoirs.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a processing system having a processor and a memory including computer program code, and a method of operating the processing system to obtain a data response of a fluid as a function of pressure of the fluid, detect an inflection pressure based on the data response, detect a downward curve pressure greater than the inflection pressure based on the data response, detect a characteristic change pressure greater than the downward curve pressure based on the data response, detect an intersection pressure of a first line through the inflection pressure and a second line through the characteristic change pressure, and estimate a dew point pressure of the fluid based on the inflection pressure, the downward curve pressure, the characteristic change pressure, and/or the intersection pressure.

The present disclosure also introduces an apparatus including a processing system having a processor and a memory including computer program code, and a method of operating the processing system to fit a model to a transmittance response of a fluid as a function of pressure to obtain a fitted response, identify an inflection pressure of the fitted response, identify a downward curve pressure of the fitted response that is greater than the inflection pressure, identify a characteristic change pressure of the fitted response that is greater than the downward curve pressure, identify an intersection pressure at an intersection of a first line and a second line, and estimate a dew point pressure of the fluid based on the inflection pressure, the downward curve pressure, the characteristic change pressure, and/or the intersection pressure. The first line is based on the inflection pressure and the fitted response, and the second line is based on the characteristic change pressure and the fitted response.

The present disclosure also introduces an apparatus including a processing system having a processor and a memory including computer program code, and a method of operating the processing system to fit a model to a transmittance response of a fluid as a function of pressure to obtain a fitted response, and to obtain a filtered response, a first-order derivative, and a second-order derivative from the fitted response. The processing system is also operated to obtain a first energy ratio function and a second energy ratio function based on the first-order derivative and the second-order derivative, respectively. The first energy ratio function and the second energy ratio function are respective ratios of a first term to a second term, the first term is based on a first sliding window along the respective first-order derivative or the second-order derivative, the second term is based on a second sliding window along the respective first-order derivative or the second-order derivative, and the first sliding window is adjacent to and along pressures less than the second sliding window. The processing system is also operated to detect an inflection pressure at a maximum peak of the first-order derivative, detect a downward curve pressure at a trough of the second-order derivative nearest to and greater than the inflection pressure, and detect a characteristic change pressure from a collection of pressures nearest to and greater than the downward curve pressure. The collection of pressures includes first identified pressures at respective peaks of the first energy ratio function and second identified pressures at respective peaks of the second energy ratio function. The processing system is also operated to detect an intersection pressure at an intersection of a first line and a second line. The first line is based on the fitted response at the inflection pressure and the first-order derivative at the inflection pressure, and the second line is based on the fitted response at the characteristic change pressure and the first-order derivative at the characteristic change pressure. The processing system is also operated to estimate a dew point pressure of the fluid based on the inflection pressure, the downward curve pressure, the characteristic change pressure, and/or the intersection pressure.

The present disclosure also introduces an apparatus including a processing system having a processor and a memory including computer program code, and a method of operating the processing system to obtain a data response of a fluid as a function of pressure of the fluid, and to estimate a dew point pressure of the fluid by detecting an inflection pressure of a function representative of the data response. The estimated dew point pressure is the inflection pressure.

The present disclosure also introduces an apparatus including a processing system having a processor and a memory including computer program code, and a method of operating the processing system to obtain a data response of a fluid as a function of pressure of the fluid, detect an inflection pressure of a function representative of the data response, and estimate a dew point pressure of the fluid by detecting a downward curve pressure of the function representative of the data response. The downward curve pressure is greater than the inflection pressure, and the estimated dew point pressure is the downward curve pressure.

The present disclosure also introduces an apparatus including a processing system having a processor and a memory including computer program code, and a method of operating the processing system to obtain a data response of a fluid as a function of pressure of the fluid, detect an inflection pressure of a function representative of the data response, and detect a downward curve pressure of the function representative of the data response. The downward curve pressure is greater than the inflection pressure. The processing system is also operated to estimate a dew point pressure of the fluid by detecting a characteristic change pressure of the function representative of the data response. The characteristic change pressure is greater than the downward curve pressure, and the estimated dew point pressure is the characteristic change pressure.

The present disclosure also introduces an apparatus including a processing system having a processor and a memory including computer program code, and a method of operating the processing system to obtain a data response of a fluid as a function of pressure of the fluid, detect an inflection pressure of a function representative of the data response, and detect a downward curve pressure of the function representative of the data response. The downward curve pressure is greater than the inflection pressure. The processing system is also operated to detect a characteristic change pressure of the function representative of the data response. The characteristic change pressure is greater than the downward curve pressure. The processing system is also operated to estimate a dew point pressure of the fluid by detecting an intersection pressure of a first line through the inflection pressure in the function representative of the data response and a second line through the characteristic change pressure in the function representative of the data response. The estimated dew point pressure is the intersection pressure.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
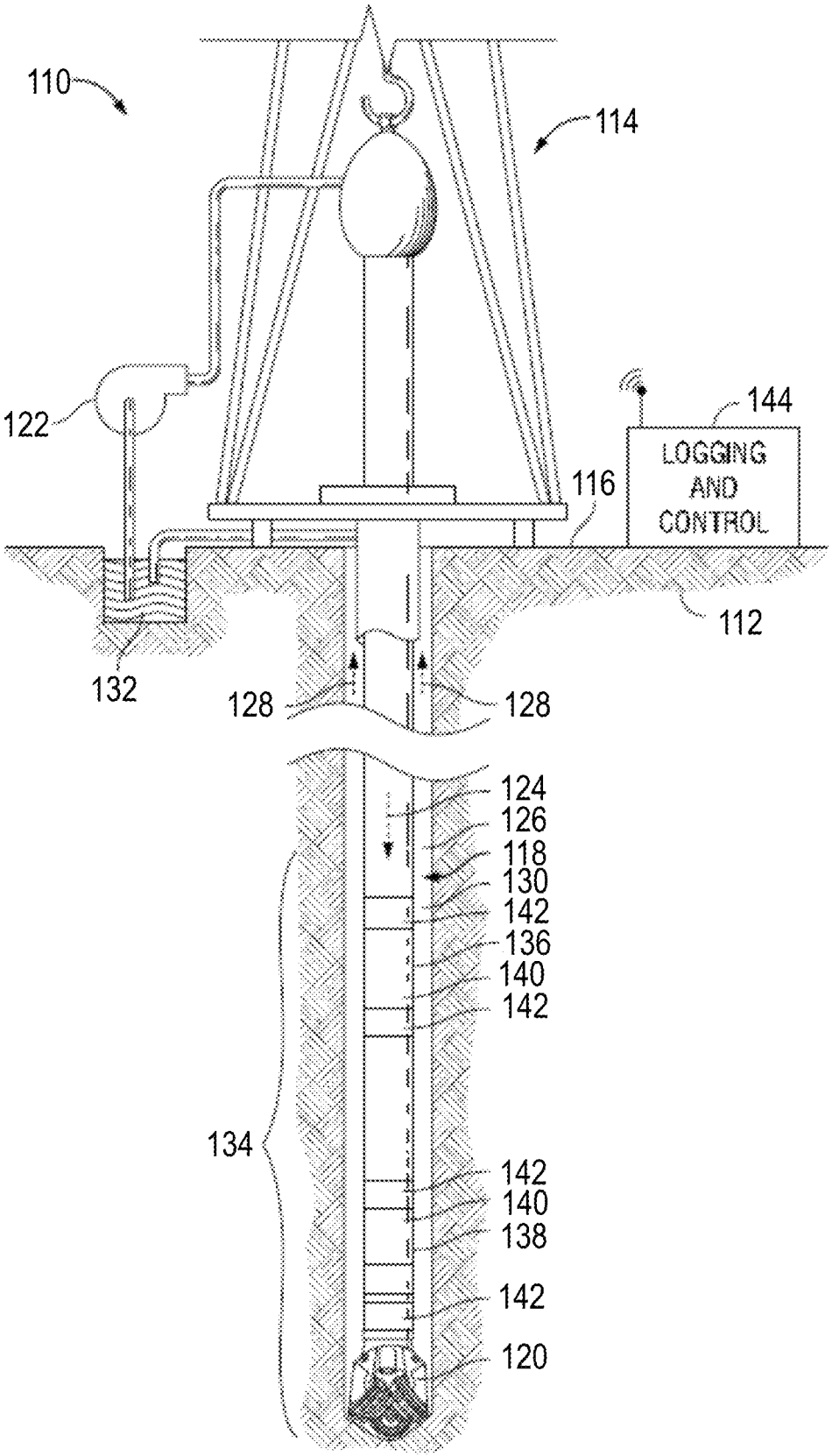
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

Systems and methods and/or processes according to one or more aspects of the present disclosure may be used or performed in connection with formation evaluation using fluid sampling and analysis. For example, a dew point pressure, asphaltene onset pressure (AOP), saturation pressure, and/or other pressure of a gas condensate and/or other fluid can implicate operation decisions for a wellsite. One or more aspects of systems and methods and/or processes disclosed herein may permit predicting a dew point pressure of a fluid in real-time and in situ at the wellsite. This real-time information may be used to direct operation decisions, such as for production pressures, among others. For example, an operator may better determine an appropriate pressure at which a wellbore may be maintained during production while avoiding condensate banking.

Various aspects presented in the present disclosure are described in the context of specifically determining dew point pressure, AOP, and/or other pressure parameters. However, one or more of such aspects are also applicable or readily adaptable to determining pressure parameters other than as explicitly described. Thus, for example, a system, method, and/or process introduced herein may be described as being for determining dew point pressure, but it is to be understood that such implementations may also be applied or readily adapted for determining AOP, another saturation pressure, and/or other pressure parameters, and that these applicable and/or adapted implementations are also deemed to be within the scope of the present disclosure, including despite specific reference to one type of pressure but not others, where applicable.

One or more aspects of systems and methods and/or processes of the present disclosure may provide for prediction of a dew point pressure of a fluid in a subterranean formation. An optical transmittance response of a fluid as a function of pressure can be obtained during downhole fluid analysis (DFA), which can be fitted to a model to obtain a fitted response. A filtered response, a first-order derivative, and a second-order derivative can be generated from the fitted response. A pressure of the largest inflection point, e.g., an optical dew point indicator pressure ($P_{ODI}$) herein, of the fitted response is identified from the first-order derivative. A pressure of a downward curve point of the fitted response, e.g., where the fitted response has a local maximum downward curvature, is identified from the second-order derivative. A pressure of a characteristic change point of the fitted response, e.g., where the fitted response changes in some characteristic that may be indicative of an onset of dew, is identified from energy ratios of the first-order and second-order derivatives. In some example implementations described herein, the pressure of the downward curve point is greater than the pressure of the inflection point and is the pressure of the nearest downward curve point to the pressure of the inflection point. In some example implementations described herein, the pressure of the characteristic change point is greater than the pressure of the downward curve point and is the pressure of the nearest characteristic change point to the pressure of the downward curve point. Using the pressures of the inflection point and characteristic change point, an intersection point may be determined. For example, an intersection of a first line and a second line may be the intersection point, where the first line is constructed from the pressure of the inflection point, the fitted response at the pressure of the inflection point, and the slope of the fitted response at the pressure of the inflection point, and where the second line is constructed from the pressure of the characteristic change point, the fitted response at the pressure of the characteristic change point, and the slope of the fitted response at the pressure of the characteristic change point. The inflection point, the downward curve point, the characteristic change point, and the intersection point may each be a candidate for an estimated dew point pressure. In some example implementations, the pressure of the inflection point is the estimated dew point pressure.

The above-described prediction of a dew point pressure of a fluid may be performed in situ during DFA and may be provided real-time. This information may permit increased productivity and efficiency of wellsite operations. Some example systems are provided herein for context to understand one or more aspects of methods and/or processes disclosed herein. A person having ordinary skill in the art will readily understand that one or more aspects of methods and/or processes disclosed herein may be used in other contexts, including other systems. Additionally, one or more aspects of the disclosure may be used in the detection and prediction of other phase-transition pressures of a fluid, such as asphaltene onset pressure (AOP).

FIG. 1 is a schematic view of at least a portion of a drilling system 110 operable to drill a wellbore 126 into one or more subsurface formations 112. One or more aspects described above may be performed by or in conjunction with one or more aspects of the drilling system 110 shown in FIG. 1.

A drilling rig 114 at the wellsite surface 116 is operable to rotate a drill string 118 that includes a drill bit 120 at its lower end. As the drill bit 120 is rotated, a pump 122 pumps drilling fluid, such as oil-based mud (OBM) in this example, downward through the center of the drill string 118 in the direction of arrow 124 to the drill bit 120. The OBM cools and lubricates the drill bit 120 and exits the drill string 118 through ports (not shown) in the drill bit 120. The OBM then carries drill cuttings away from the bottom of the wellbore 126 as it flows back to the wellsite surface 116 through an annulus 130 between the drill string 118 and the subsurface formation 112, as shown by arrows 128. At the wellsite surface 116, the return OBM is filtered and conveyed back to a mud pit 132 for reuse.

While a drill string 118 is illustrated in FIG. 1, it will be understood that implementations described herein may be applicable or readily adaptable to work strings and wireline tools as well. Work strings may include a length of tubing (e.g., coiled tubing) lowered into the wellbore 126 for conveying well treatments or well servicing equipment. Wireline tools may include formation testing tools suspended from a multi-conductor cable as the cable is lowered into the wellbore 126 to measure formation properties at depths, as described in more detail below.

The location and environment of the drilling system 110 may vary depending on the subsurface formation 112 penetrated by the wellbore 126. Instead of being a surface operation, for example, the wellbore 126 may be formed under water of varying depths, such as on an ocean bottom surface. Some components of the drilling system 110 may be specially adapted for underwater wells in such instances.

The lower end of the drill string 118 includes a bottom-hole assembly (BHA) 134, which includes the drill bit 120 and a plurality of drill collars 136, 138. The drill collars 136, 138 may include various instruments, such as sample-while-drilling (SWD) tools that include sensors, telemetry equipment, and so forth. For example, the drill collars 136, 138 may include logging-while-drilling (LWD) modules 140 and/or measurement-while drilling (MWD) modules 142. The LWD modules 140 may include tools operable to measure formation parameters and/or fluid properties, such as resistivity, porosity, permeability, sonic velocity, optical density (OD), pressure, temperature, and/or other example properties. The MWD modules 142 may include tools operable to measure wellbore trajectory, borehole temperature, borehole pressure, and/or other example properties. The LWD modules 140 may each be housed in one of the drill collars 136, 138, and may each contain one or more logging tools, one or more pressure-volume-temperature (PVT) tools, one or more fluid sampling devices, and/or the like. The LWD modules 140 include capabilities for measuring, processing, and/or storing information, as well as for communicating with the MWD modules 142 and/or with surface equipment such as, for example, a logging and control unit 144. That is, the SWD tools (e.g., LWD modules 140 and MWD modules 142) may be communicatively coupled to the logging and control unit 144 disposed at the wellsite surface 116. In other implementations, portions of the logging and control unit 144 may be integrated with downhole features.

The LWD modules 140 and/or the MWD modules 142 may include a downhole formation fluid sampling tool operable to selectively sample fluid from the subsurface formation 112. The drilling system 110 may be operable to determine, estimate, or otherwise obtain various properties associated with the sampled formation fluid. For example, the LWD modules 140 and/or the MWD modules 142 may include a PVT tool, such as a microfluidic PVT tool, that analyzes formation fluid properties relating to pressure, volume, and temperature. Properties may be determined within or communicated to the logging and control unit 144, such as for subsequent utilization as input to various control functions and/or data logs.

Figure 2:
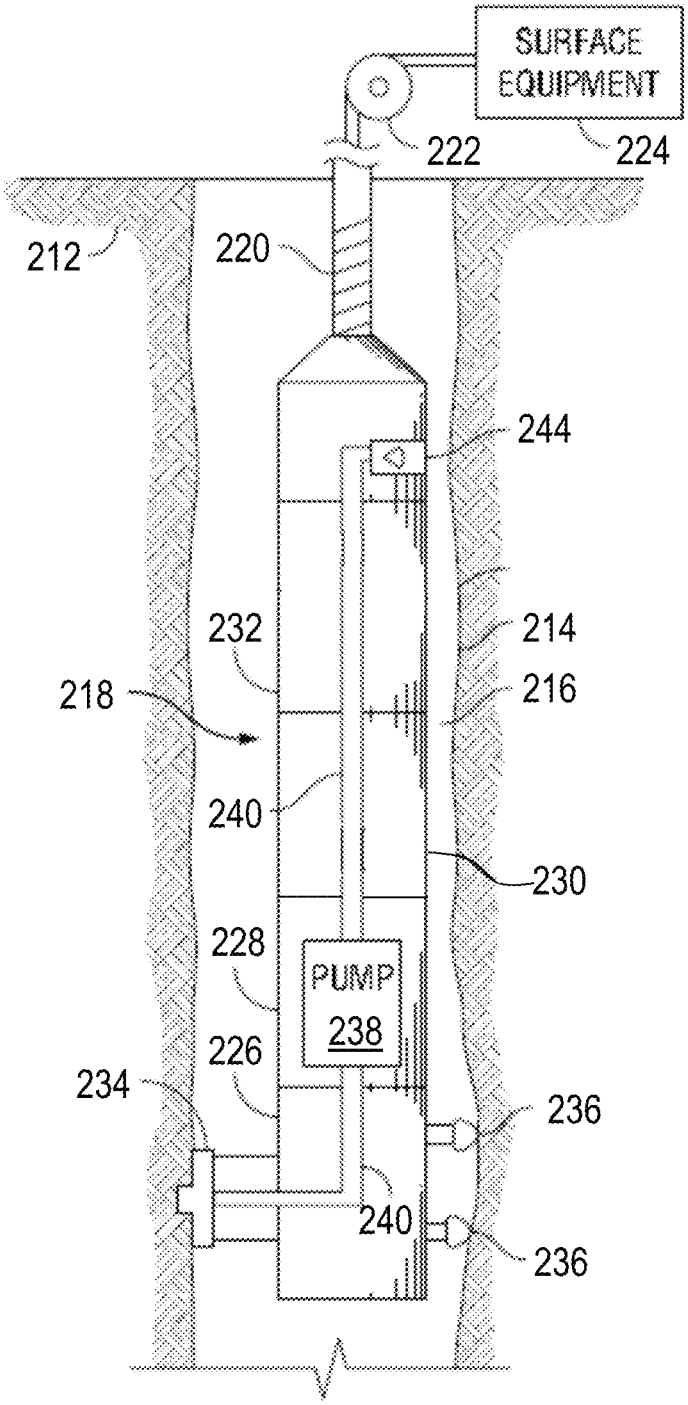
FIG. 2 is a schematic view of at least a portion of an example implementation of apparatus according to one or more aspects of the present disclosure.

FIG. 2 is a schematic diagram of an example implementation of downhole equipment (equipment configured for operation downhole) operable to sample fluid from a formation, such as the subsurface formation 212 shown in FIG. 2. The downhole equipment includes an example implementation of a downhole formation fluid sampling tool 218, hereinafter referred to as the downhole tool 218. The downhole tool 218 is conveyable within the wellbore 214 to the subsurface formation 212 and subsequently operable to sample formation fluid from the subsurface formation 212. In the illustrated example implementation, the downhole tool 218 is conveyed in the wellbore 214 via a wireline 220. The downhole tool 218 may be suspended in the wellbore 214 from a lower end of the wireline 220, which may be a multi-conductor cable spooled from a winch 222 at the surface. The wireline 220 may be electrically coupled to wellsite surface equipment 224, such as to communicate various control signals and logging information between the downhole tool 218 and the wellsite surface equipment 224. The wellsite surface equipment 224 shown in FIG. 2 and the logging and control unit 144 shown in FIG. 1, or functions thereof, may be integrated in a single system at the wellsite surface.

The downhole tool 218 includes a probe module 226, a pumpout module 228, a PVT module 230, and a sample module 232, one or more of which may comprise, be part of, be substantially similar to, or otherwise have similar functionality relative to one or more of the SWD tools, LWD modules 140, and/or MWD modules 142 shown in FIG. 1 and/or described above. However, other arrangements and/or modules may make up the downhole tool 218.

The probe module 226 may comprise an extendable fluid communication line (probe 234) operable to engage the subsurface formation 212 and communicate fluid samples from the subsurface formation 212 into the downhole tool 218. The probe module 226 may also comprise one or more setting mechanisms 236. The setting mechanisms 236 may include pistons and/or other apparatus operable to improve sealing engagement and thus fluid communication between the subsurface formation 212 and the probe 234. The probe module 226 may also comprise one or more packer elements (not shown) that inflate or are otherwise operable to contact an inner wall of the wellbore 214, thereby isolating a section of the wellbore 214 for sampling. The probe module 226 may also comprise electronics, batteries, sensors, and/or hydraulic components used, for example, to operate the probe 234 and/or the corresponding setting mechanisms 236.

The pumpout module 228 may comprise a pump 238 operable to create a pressure differential that draws the formation fluid in through the probe 234 and pushes the fluid through a flowline 240 of the downhole tool 218. The pump 238 may comprise an electromechanical, hydraulic, and/or other type of pump operable to pump formation fluid from the probe module 226 to the sample module 232 and/or out of the downhole tool 218. The pump 238 may operate as a piston displacement unit (DU) driven by a ball screw coupled to a gearbox and an electric motor, although other types of pumps 238 are also within the scope of the present disclosure. Power may be supplied to the pump 238 via other components located in the pumpout module 228, or via a separate power generation module (not shown). During a sampling period, the pump 238 moves the formation fluid through the flowline 240 toward the sample module 232.

The pumpout module 228 may also include a spectrometer (not shown) operable to measure characteristics of the formation fluid as it flows through the flowline 240. The spectrometer may be located downstream or upstream of the pump 238. The characteristics sensed by the spectrometer may include OD of the formation fluid. Data collected via the spectrometer may be utilized to control the downhole tool 218. Based on the OD and/or other characteristics of the formation fluid detected via sensors (e.g., the spectrometer) along the flowline 240, the downhole tool 218 may be operated in a sample collection mode or a continuous pumping (cleanup) mode. For example, the downhole tool 218 may not operate in a sample collection mode until the formation fluid flowing through the flowline 240 exhibits characteristics of a clean formation fluid sample, as detected by or otherwise determined in conjunction with operation of the spectrometer. A clean formation fluid sample contains a relatively low level of contaminants (e.g., drilling mud filtrate) that are miscible with the formation fluid when extracted from the subsurface formation 212.

The PVT module 230 may comprise one or more sensors (not shown) for observing and/or analyzing properties of the formation fluid relating to one or more of pressure, volume, and temperature. For example, the PVT module 230 may comprise one or more of a phase transition cell, a densitometer, a viscometer, a pressure control device, a pressure gauge, a temperature gauge, an optical spectrometer, and/or other example sensors. The sensors can be in fluid communication with the flowline 240 to receive the formation fluid. Further, the sensors may be in a configuration to be fluidly isolated from the flowline 240 during some operations, such as by having one or more valves disposed between the sensors and the flowline 240. When the downhole tool 218 is operated during continuous pumping (cleanup) mode, the sensors may remain fluidly isolated from the flowline 240. When the downhole tool 218 is operated during a sample collection mode or similar operation, the sensors may receive sample formation fluid, and once the fluid is received, the sensors may be fluidly isolated from the flowline 240 for one or more operations to be performed on the received fluid, such as depressurization.

The sample module 232 may comprise one or more sample bottles (not shown) for collecting samples of the formation fluid. When operated in the sample collection mode, valves (not shown) disposed at or near entrances of the sample bottles may be positioned to permit the formation fluid to flow into the sample bottles. The sample bottles may be filled one at a time, and once a sample bottle is filled, its corresponding valve may be moved to another position to seal the sample bottle. When the valves are closed, the downhole tool 218 may operate in a continuous pumping mode.

In the continuous pumping mode, the pump 238 moves the formation fluid into the downhole tool 218 through the probe 234, through the flowline 240, and then out of the downhole tool 218 through an exit port 244. The exit port 244 may be a check valve that releases the formation fluid into the annulus 216 of the wellbore 214. The downhole tool 218 may operate in the continuous pumping mode until the formation fluid flowing through the flowline 240 is determined to be clean enough for sampling. That is, when the formation fluid is first obtained from the subsurface formation 212, for example, OBM filtrate that has been forced into the subsurface formation 212 via the drilling operations may enter the downhole tool 218 along with the obtained formation fluid. After pumping the formation fluid for an amount of time, the formation fluid flowing through the downhole tool 218 will provide a cleaner fluid sample of the subsurface formation 212 than would otherwise be available when first drawing fluid in through the probe 234.

One or more functions and/or other aspects of the downhole tool 218 may also be applicable or readily adaptable to at least a portion of the downhole apparatus shown in FIG. 1. For example, one or more of the SWD tools, LWD modules 140, and/or MWD modules 142 shown in FIG. 1 and/or described above may have one or more functions and/or other aspects in common with a corresponding portion(s) of the downhole tool 218 shown in FIG. 2.

Figure 3:
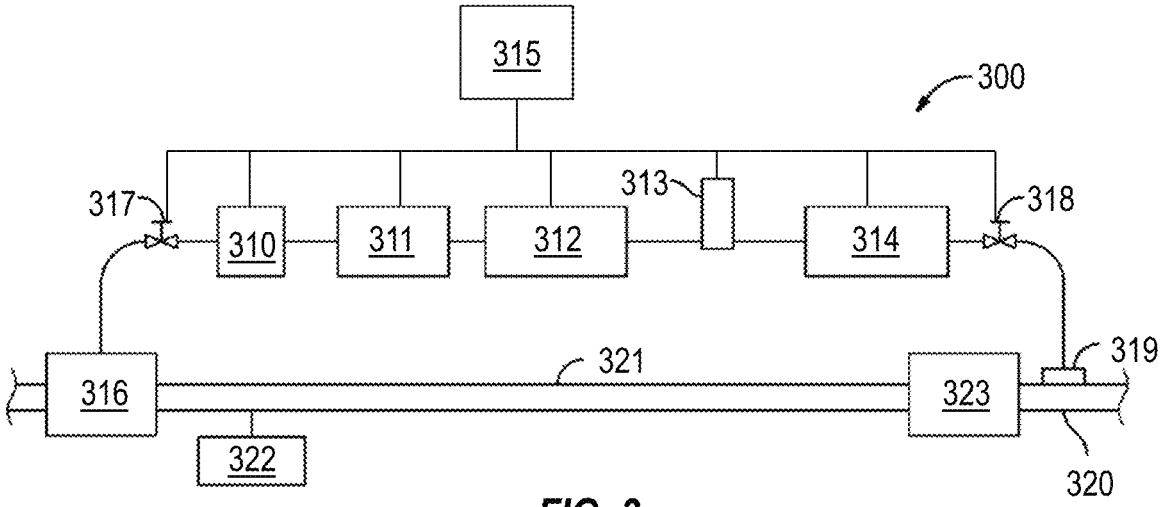
FIG. 3 is a schematic view of at least a portion of an example implementation of apparatus according to one or more aspects of the present disclosure.

FIG. 3 is a schematic diagram of an example implementation of a PVT apparatus 300 of at least a portion of downhole equipment (equipment configured for operation downhole) operable to measure properties of a formation fluid, such as the formation fluid of the subsurface formations 112, 212 shown in FIGS. 1 and 2. In some embodiments, the PVT apparatus 300 may be included into another measurement tool or may be a standalone tool, for example. The LWD modules 140, and/or MWD modules 142 shown in FIG. 1 and the PVT module 230 of FIG. 2 may be or comprise the PVT apparatus 300 shown in FIG. 3.

The PVT apparatus 300, as shown in the illustrated example, includes a phase transition cell 310, a densitometer 311, a viscometer 312, a pressure control device 313, and a pressure gauge 314 that are in fluid communication between valves 317, 318. In some example implementations, some of the illustrated sensors, such as the densitometer 311 and viscometer 312, for example, may be omitted. In some example implementations, other sensors, such as a temperature gauge and an optical spectrometer to detect fluid phase changes, may additionally be included. Various combinations of sensors are within the scope of the present disclosure.

The phase transition cell 310 can measure and quantify optical transmittance of the fluid using optical measurements. The phase transition cell 310 can include a flowline constrained by two windows or lenses. Light in the optical path between the two windows or lenses may be highly sensitive to the presence of fluid interfaces, such as that associated with bubbles in a liquid (produced at bubble point) or liquid droplets in a gas (produced at dew point). A wire may be orthogonal to the flow path of the fluid in the phase transition cell 310 for thermally agitating the fluid to overcome a nucleation barrier. A current pulse through the wire may heat the fluid surrounding the wire. As the heat dissipates and the local temperature returns to that of the system, bubbles formed in a liquid sample or dew in a gas sample either collapse or remain stable, depending on whether the pressure in the phase transition cell 310 is above the saturation pressure or within the two-phase region, respectively.

The densitometer 311 can measure the density of the fluid. The densitometer 311 may be or comprise a microfluidic vibrating tube densitometer and/or another example densitometer. The viscometer 312 can measure viscosity of the fluid. The viscometer may be or comprise a microfluidic vibrating wire viscometer and/or another example viscometer.

The pressure control device 313 can control or alter pressure within the PVT apparatus 300. In some example implementations, the pressure control device 313 is a piston in a piston housing, and in further example implementations, the pressure control device 313 can be other devices. In some example implementations, the pressure control device 313 is used to depressurize fluid in the PVT apparatus 300. For example, the pressure control device 313 may be able to depressurize the fluid at a rate of 100 psi/second for a duration of approximately 5 minutes.

The pressure gauge 314 can measure the pressure of the fluid in the PVT apparatus 300. The pressure gauge 314 can be any pressure gauge operable in the local application environment. The pressure gauge 314 may provide pressure measurements that are collated with data from other sensors, such as from the phase transition cell 310, during depressurization.

FIG. 3 further provides a schematic view of the example implementation of the PVT apparatus 300 in combination with other elements. The components may be configured to work together or individually to observe and/or analyze a fluid sample. Additional or fewer components may be included in some implementations.

In the illustrated implementation, fluid is collected through a membrane 316. The membrane 316 may be housed in a frame configured to support the membrane. In some embodiments, the membrane 316 prevents particles with a given dimension or larger from flowing through the membrane 316. As illustrated, the fluid is flowed through the membrane 316 as in a cross-flow. In other examples, fluid can be flowed across the membrane as in dead-end filtration.

The fluid flows through the membrane 316 and through tubing to an entry valve 317. The entry valve 317 may be a needle valve, ball valve, or another valve operable for the local environment application. The entry valve 317 is controlled to permit or prevent fluid flow through the PVT apparatus 300, such as the phase transition cell 310. The valve 317 may be closed in some operations. With the entry valve 317 open, the fluid flows through the phase transition cell 310, the densitometer 311, the viscometer 312, and the pressure control device 313 and exerts a pressure on the pressure gauge 314. The fluid may flow on to an exit valve 318. The exit valve 318 may be a needle valve, ball valve, or another valve operable for the local environment application. The exit valve 318 is controlled to permit or prevent fluid flow to a back pressure regulator 319. The valve 318 may be closed in some operations. Fluid may be sent downhole through flowline 320 after flowing through the exit valve 318.

Some examples may include a bypass flowline 321 with a pressure gauge 322 and pressure control device 323. Fluid may be sent downhole through flowline 320, for example, from the bypass flowline 321. Other examples may omit the bypass flowline 321 and/or one or more of the components associated with the bypass flowline 321.

The example PVT apparatus 300 also includes a control/monitoring system 315. The control/monitoring system 315 can include one or more processors and memory, where the memory stores program code instructions, such as firmware and/or software, that is to be executed by the one or more processors. In the context of the present disclosure, the term "processor" can refer to any number of processor components. The processor may include a single processor disposed onboard the downhole tool. In other implementations, at least a portion of the processor (e.g., where multiple processors collectively operate as the processor) may be located within the wellsite surface equipment 224 of FIG. 2, the logging and control unit 144 of FIG. 1, and/or other surface equipment components. The processor may also or instead be or include one or more processors located within the downhole tool 218 and connected to one or more processors located in drilling and/or other equipment disposed at the wellsite surface. Moreover, various combinations of processors may be considered part of the processor in the following description.

The control/monitoring system 315 is communicatively coupled to the phase transition cell 310, densitometer 311, viscometer 312, pressure control device 313, pressure gauge 314, and valves 317, 318. The control/monitoring system 315 can control the operation of components of the PVT apparatus 300. In an example depressurization process, the control/monitoring system 315 can actuate the valves 317, 318 to close once the PVT apparatus 300 has received a formation fluid, and can actuate the pressure control device 313, such as to retract the piston, to depressurize the formation fluid contained between the valves 317, 318 in the PVT apparatus 300. Further, during the example depressurization process, the control/monitoring system 315 can receive and collate measurements from sensors, such as the phase transition cell 310, densitometer 311, viscometer 312, and pressure gauge 314, and can transmit the collated data to surface equipment, such as the logging and control unit 144 and/or other wellsite surface equipment depicted in FIG. 1 and/or the wellsite surface equipment 224 shown in FIG. 2. For example, the phase transition cell 310 can measure the optical transmittance of the fluid during depressurization, and the pressure gauge 314 can measure the pressure of the fluid. The control/monitoring system 315 can received the measurements form the phase transition cell 310 and the pressure gauge 314, collate the measurements to obtain an optical transmittance response as a function of pressure, and transmit the optical transmittance response to surface equipment.

The control/monitoring system 315 can control, monitor, and/or communicate with other devices and components. Additionally, the control/monitoring system 315 can implement one or more aspects of example methods described herein.

Figure 4:
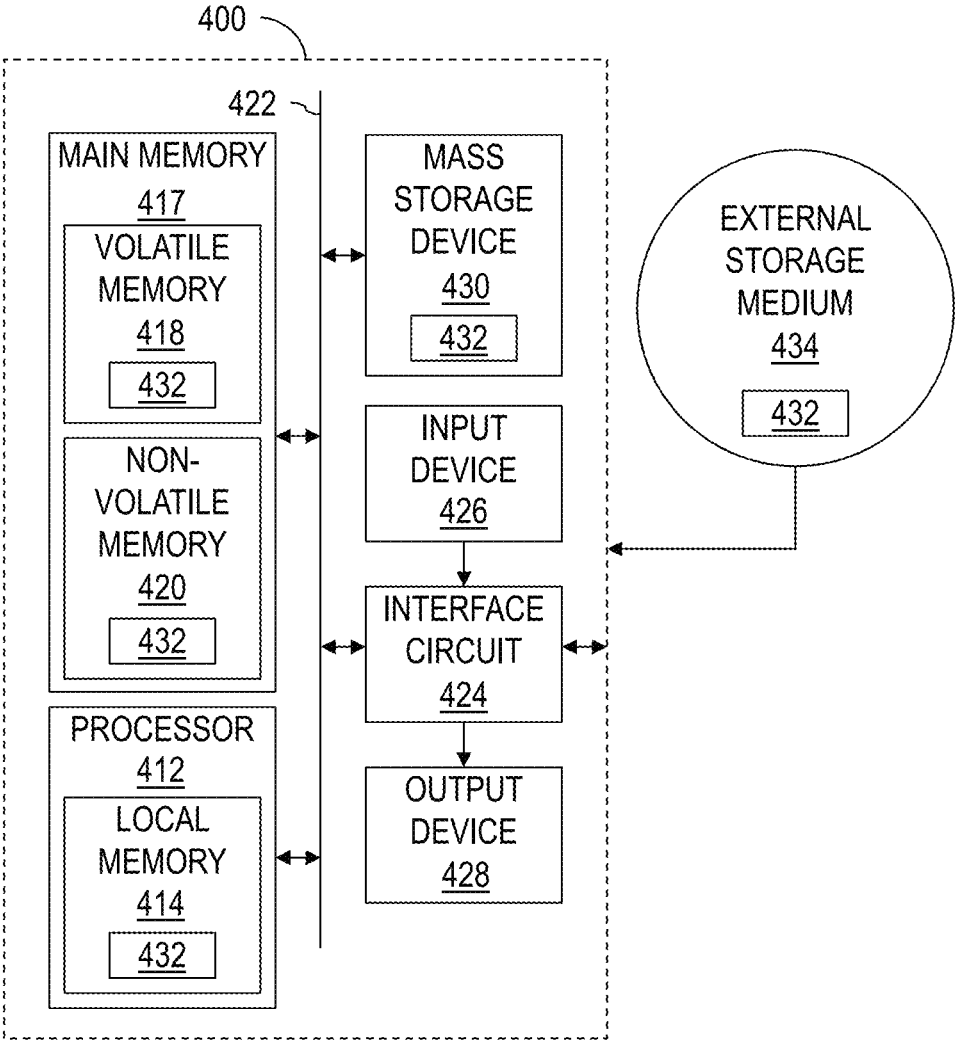
FIG. 4 is a schematic view of at least a portion of an example implementation of apparatus according to one or more aspects of the present disclosure.

FIG. 4 is a schematic view of at least a portion of an example implementation of a processing system 400 according to one or more aspects of the present disclosure. The processing system 400 may execute example machine-readable instructions to implement at least a portion of one or more of the methods and/or processes described herein, and/or to implement a portion of one or more of the example downhole tools described herein.

The processing system 400 may be or comprise, for example, one or more processors, controllers, special-purpose computing devices, servers, personal computers, personal digital assistant (PDA) devices, smartphones, internet appliances, and/or other types of computing devices. Moreover, while it is possible that the entirety of the processing system 400 shown in FIG. 4 is implemented within a downhole tool, such as the downhole tools and/or modules shown in one or more of FIGS. 1-3, one or more components or functions of the processing system 400 may also or instead be implemented in wellsite surface equipment, perhaps including the logging and control unit 144 and/or other wellsite surface equipment depicted in FIG. 1 and/or the wellsite surface equipment 224 shown in FIG. 2.

The processing system 400 comprises a processor 412 such as, for example, a general-purpose programmable processor. The processor 412 may comprise a local memory 414, and may execute program code instructions 432 present in the local memory 414 and/or in another memory device. The processor 412 may execute, among other things, machine-readable instructions or programs to implement the methods and/or processes described herein. The programs stored in the local memory 414 may include program instructions or computer program code that, when executed by an associated processor, enable surface equipment and/or a downhole tool to perform tasks as described herein. The processor 412 may be, comprise, or be implemented by one or more processors of various types operable in the local application environment, and may include one or more general purpose processors, special-purpose processors, microprocessors, digital signal processors (DSPs), field-programmable gate arrays (FPGAs), application-specific integrated circuits (ASICs), processors based on a multi-core processor architecture, and/or other processors. More particularly, examples of a processor 412 include one or more INTEL microprocessors, microcontrollers from the ARM and/or PICO families of microcontrollers, embedded soft/hard processors in one or more FPGAs, etc.

The processor 412 may be in communication with a main memory 417, such as via a bus 422 and/or other communication means. The main memory 417 may comprise a volatile memory 418 and a non-volatile memory 420. The volatile memory 418 may be, comprise, or be implemented by tangible, non-transitory storage medium, such as random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 420 may be, comprise, or be implemented by tangible, non-transitory storage medium, such as read-only memory, flash memory and/or other types of memory devices. One or more memory controllers (not shown) may control access to the volatile memory 418 and/or the non-volatile memory 420.

The processing system 400 may also comprise an interface circuit 424. The interface circuit 424 may be, comprise, or be implemented by various types of standard interfaces, such as an Ethernet interface, a universal serial bus (USB), a third generation input/output (3GIO) interface, a wireless interface, and/or a cellular interface, among other examples. The interface circuit 424 may also comprise a graphics driver card. The interface circuit 424 may also comprise a communication device such as a modem or network interface card to facilitate exchange of data with external computing devices via a network, such as via Ethernet connection, digital subscriber line (DSL), telephone line, coaxial cable, cellular telephone system, and/or satellite, among other examples.

One or more input devices 426 may be connected to the interface circuit 424. One or more of the input devices 426 may permit a user to enter data and/or commands for utilization by the processor 412. Each input device 426 may be, comprise, or be implemented by a keyboard, a mouse, a touchscreen, a track-pad, a trackball, an image/code scanner, and/or a voice recognition system, among other examples.

One or more output devices 428 may also be connected to the interface circuit 424. One or more of the output device 428 may be, comprise, or be implemented by a display device, such as a liquid crystal display (LCD), a light-emitting diode (LED) display, and/or a cathode ray tube (CRT) display, among other examples. One or more of the output devices 428 may also or instead be, comprise, or be implemented by a printer, speaker, and/or other examples.

The processing system 400 may also comprise a mass storage device 430 for storing machine-readable instructions and data. The mass storage device 430 may be connected to the interface circuit 424, such as via the bus 422. The mass storage device 430 may be or comprise tangible, non-transitory storage medium, such as a floppy disk drive, a hard disk drive, a compact disk (CD) drive, and/or digital versatile disk (DVD) drive, among other examples. The program code instructions 432 may be stored in the mass storage device 430, the volatile memory 418, the non-volatile memory 420, the local memory 414, a removable storage medium, such as a CD or DVD, an external storage medium 434, and/or another storage medium.

The modules and/or other components of the processing system 400 may be implemented in accordance with hardware (such as in one or more integrated circuit chips, such as an ASIC), or may be implemented as software or firmware for execution by a processor. In the case of firmware or software, the implementation can be provided as a computer program product including a computer readable medium or storage structure containing computer program code (i.e., software or firmware) for execution by the processor.

The following methods or processes may permit prediction of a dew point pressure of a fluid, such as a gas condensate or the like. The methods or processes are described in the context of devices and components described above, although in other implementations also within the scope of the present disclosure, methods or processes within the scope of this disclosure may be performed in the context of other devices and components. The methods or processes described below are presented in a given order, although other implementations also within the scope of the present disclosure may comprise the described and/or other methods or processes in other orders and/or in parallel. Various other modifications to the methods or processes described below may also be consistent with the scope of the present disclosure. For example, such implementations may include additional or fewer calculations, determinations, computations, logic, monitoring, and/or other aspects. Additionally, in some example implementations, operations described in some examples herein may be omitted when a given pressure that is to be used as an estimated dew point pressure has been obtained, for example.

An estimated dew point of the fluid may be determined during in situ fluid analysis. The following description relates to methods and/or processes for determining an estimated dew point of the fluid. As described in example implementations below, an inflection pressure, a downward curve pressure, a characteristic change pressure, and an intersection pressure are determined based on a function that is representative of the optical transmittance response of the fluid. Any one or more of the inflection pressure, downward curve pressure, characteristic change pressure, and intersection pressure may be the estimated dew point pressure. Some example implementations use a fitted response as the representative function that is determined by fitting a polynomial model to the optical transmittance response, and a filtered response, first-order derivative, and second-order derivative may be easily obtainable from the fitted response. The inflection pressure may be determined from the first-order derivative of the fitted response, and the downward curve pressure may be determined from the second-order derivative of the fitted response and based on the inflection pressure. The characteristic change pressure may be determined from energy ratio functions and based on the downward curve pressure, and the energy ratio functions are generated from the first-order and second-order derivatives. Lines, the intersection of which may be the intersection pressure, may be constructed using the inflection pressure, the characteristic change pressure, the first-order derivative, and the filtered response.

Figure 5:
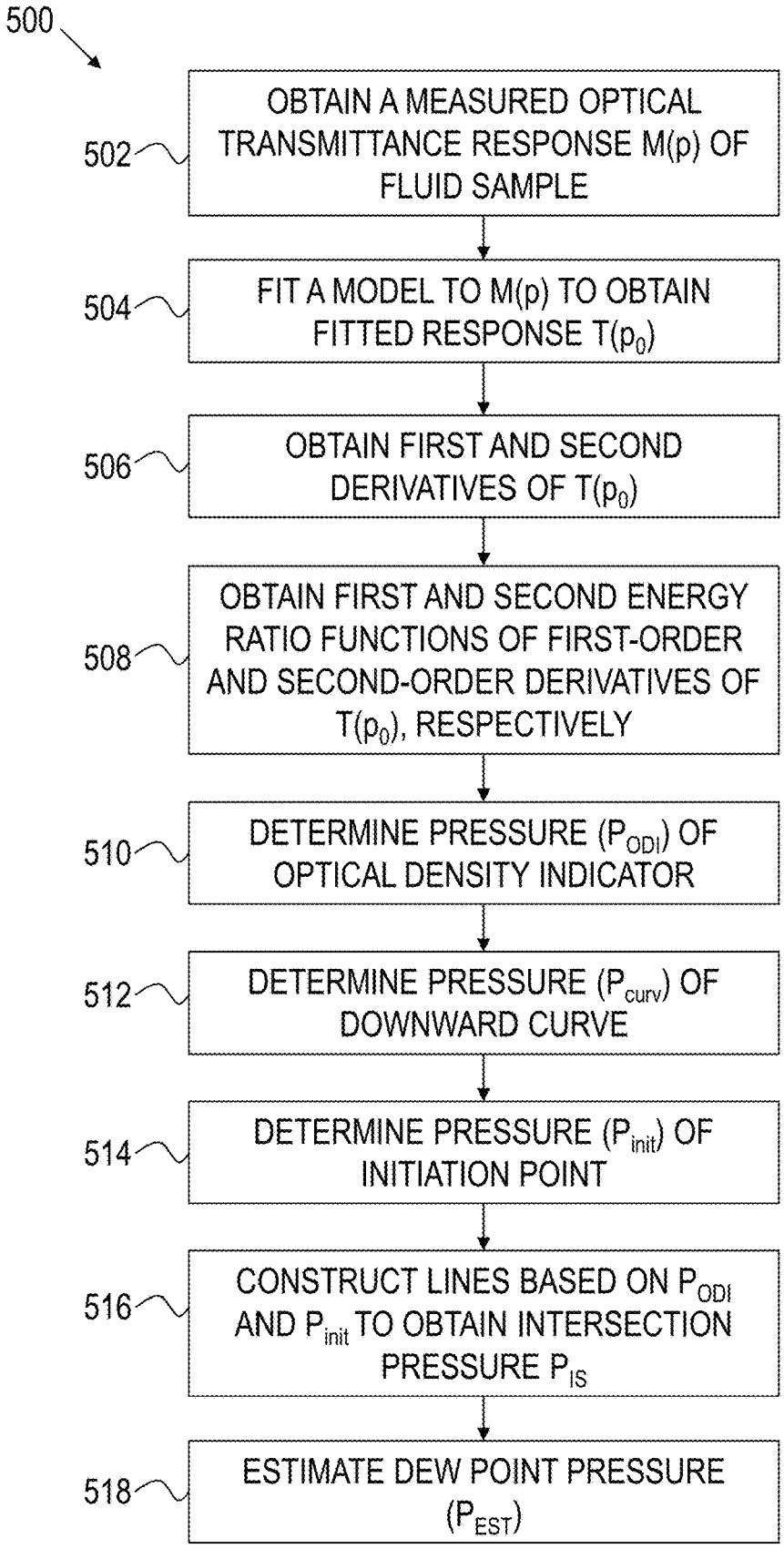
FIG. 5 is a flow-chart diagram of at least a portion of an example implementation of a method according to one or more aspects of the present disclosure.

FIG. 5 is a flow-chart diagram of at least a portion of an example implementation of a method (500) for determining an estimated dew point pressure of a fluid according to one or more aspects of the present disclosure. The method (500) may be performed at a wellsite, such as illustrated in FIGS. 1 and 2, and may be performed by a processing system, such as illustrated in FIGS. 3 and/or 4. The method (500) may be used to obtain in situ, real-time data associated with a fluid obtained by a downhole tool disposed in a wellbore that extends into a subterranean formation. The method (500) is discussed below using an example dataset, as shown in FIGS. 6-12, to illustrate one or more aspects of the method (500). In example implementations, different datasets may be obtained and used.

Figure 6:
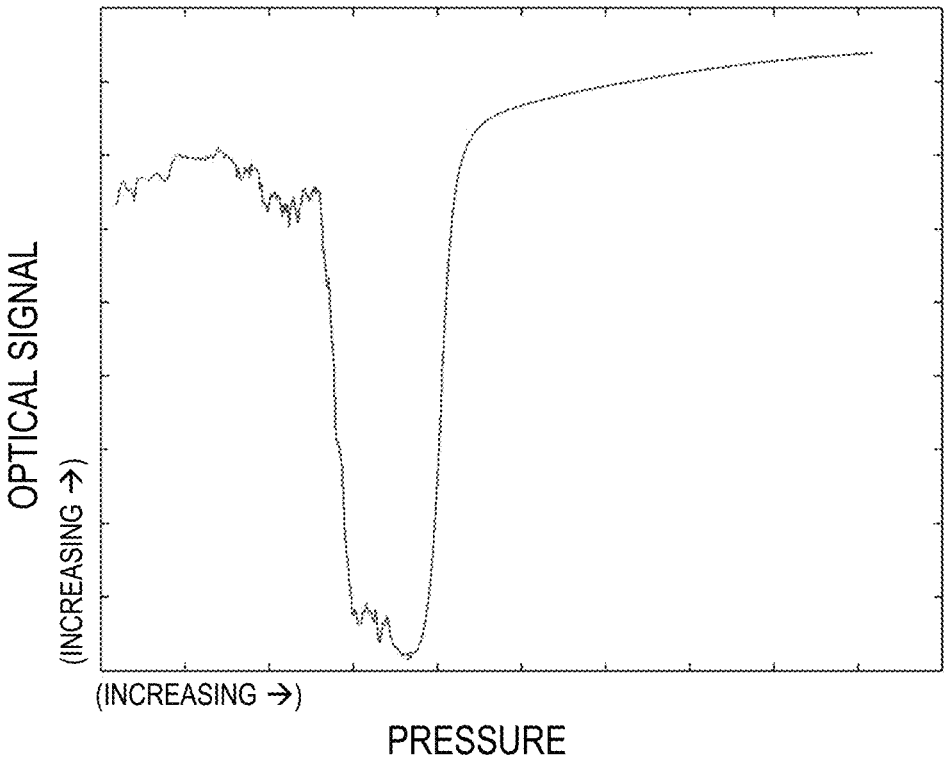
FIG. 6 is a graph depicting an example dataset according to one or more aspects of the present disclosure.

The method (500) includes obtaining (502) a measured transmittance response M(p) of a fluid sample. As described previously, a formation fluid may be obtained and depressurized in a downhole tool. During the depressurization, optical transmittance data can be obtained from a phase transition cell with respect to pressure, as described above with respect to the PVT apparatus 300 of FIG. 3. FIG. 6 is a graph illustrating an example measured optical transmittance response M(p) ("OPTICAL SIGNAL") as a function of pressure ("PRESSURE") according to one or more aspects of the present disclosure.

The method (500) of FIG. 5 includes fitting (504) a model to the measured transmittance response M(p) of the fluid to obtain a fitted transmittance response $T(p_0)$. In some example implementations, the model is a second order polynomial model (e.g., a quadratic model) fitted to sliding windows of the raw transmittance response, as shown in Equation (1) below. Other models with higher or lower orders may be used in other example implementations.

$$T(p_0)=a+b(p-p_0)+c(p-p_0)^2 \quad \text{Eq. (1)}$$

In Equation (1), the window being analyzed is $p_0-p_w/2 \le p \le p_0+p_w/2$. $T(p_0)$ is the fitted transmittance response as a function of pressure $p_0$. The pressure $p_0$ is the center and pressure width $p_w$ is the size of the window being analyzed to determine the fitted transmittance response $T(p_0)$. In determining the fitted transmittance response $T(p_0)$, the window slides through the measured transmittance response M(p), and at each location specified by $p_0$, the quadratic model is fit to the data of the measured transmittance response M(p).

The fitting (504) can use any fitting technique. In some example implementations, a least-squares criterion, as shown in Equation (2) below, is used in the window of size $p_w$ centered at pressure $p_0$.

$$\min_{a,b,c}\Sigma_{p=p_0-p_w/2}^{p_0+p_w/2}(M(p)-T(p_0))^2 \quad \text{Eq. (2)}$$

In some example implementations, a least-absolute error criterion, as shown in Equation (3) below, is used in the window of size $p_w$ centered at pressure $p_0$.

$$\min_{a,b,c}\Sigma_{p=p_0-p_w/2}^{p_0+p_w/2}|M(p)-T(p_0)| \quad \text{Eq. (3)}$$

The least-absolute error criterion can be solved using an iterative re-weighted least-squares algorithm. Other fitting techniques can be used.

In some example implementations, the fitting (504) may be omitted, for example, when the measured transmittance response M(p) is sufficiently free of noise and derivatives may easily be obtained from the measured transmittance response M(p). In other example implementations, the fitting (504) may use other models and/or fitting techniques. The example model and fitting technique described herein may permit simple detection of a filtered response and derivatives, as described in further detail below.

Figure 7:
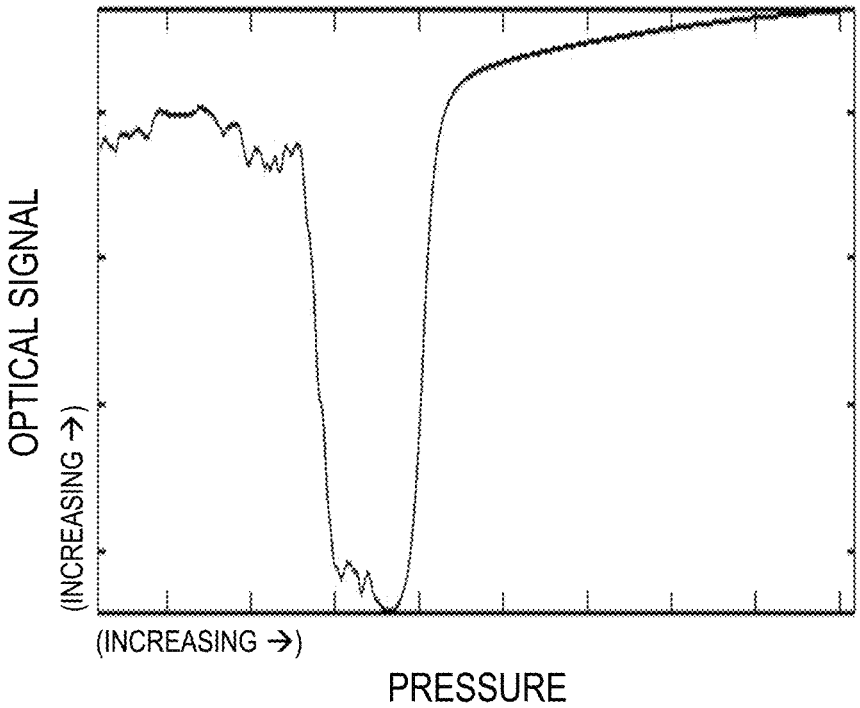
FIG. 7 is a graph depicting an example dataset according to one or more aspects of the present disclosure.

A filtered transmittance response $F_T(p_0)$ can be obtained from the constant terms of the fitted transmittance response $T(p_0)$ of Equation (1), for example. The filtered transmittance response $F_T(p_0)$ can represent the fitted transmittance response $T(p_0)$ that is de-noised. Using the quadratic model of Equation (1) above, the filtered transmittance response $F_T(p_0)$ is the constant terms a of the fitted transmittance response $T(p_0)$. FIG. 7 is a graph illustrating an example filtered transmittance response $F_T(p_0)$ ("OPTICAL SIGNAL") as a function of pressure ("PRESSURE") according to one or more aspects of the present disclosure. The example filtered transmittance response $F_T(p_0)$ of FIG. 7 is obtained from the constant terms a of an example fitted transmittance response $T(p_0)$ that is obtained by fitting the quadratic model of Equation (1) to the example measured transmittance response M(p) of FIG. 6 using the least-absolute error criterion and the iterative re-weighted least-squares algorithm. Other filtering and/or noise reduction or removal techniques may be used.

The method (500) includes obtaining (506) first-order and second-order derivatives $$\frac{dT}{dp}, \frac{d^2T}{dp^2}$$

of the fitted transmittance response $T(p_0)$. Using the quadratic model of Equation (1) above, for example, the first-order derivative $$\frac{dT}{dp}$$

of the fitted transmittance response $T(p_0)$ is the first order terms b of the fitted transmittance response $T(p_0)$, as shown below in Equation (4). Using the quadratic model of Equation (1) above, for example, the second-order derivative $$\frac{d^2T}{dp^2}$$

of the fitted transmittance response $T(p_0)$ is two times the second order terms c of the fitted transmittance response $T(p_0)$, as shown below in Equation (5).

$$\left.\frac{dT}{dp}\right|_{p=p_0} = b \qquad \text{Eq. (4)}$$

$$\left.\frac{d^2T}{dp^2}\right|_{p=p_0} = 2c \qquad \text{Eq. (5)}$$

Other techniques for obtaining the first-order and second-order derivatives $$\frac{dT}{dp}, \frac{d^2T}{dp^2}$$

of the fitted transmittance response $T(p_0)$ may be used.

Figure 8:
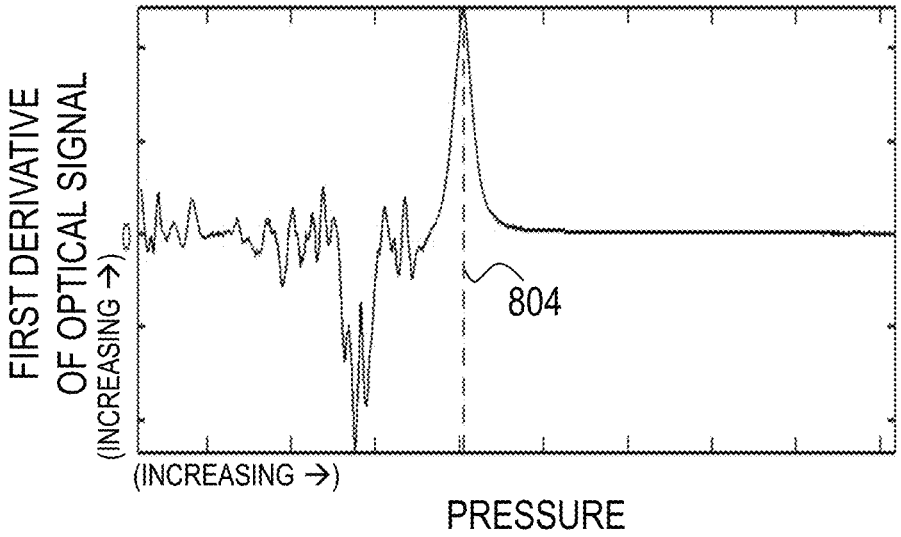
FIG. 8 is a graph depicting an example dataset according to one or more aspects of the present disclosure.
Figure 9:
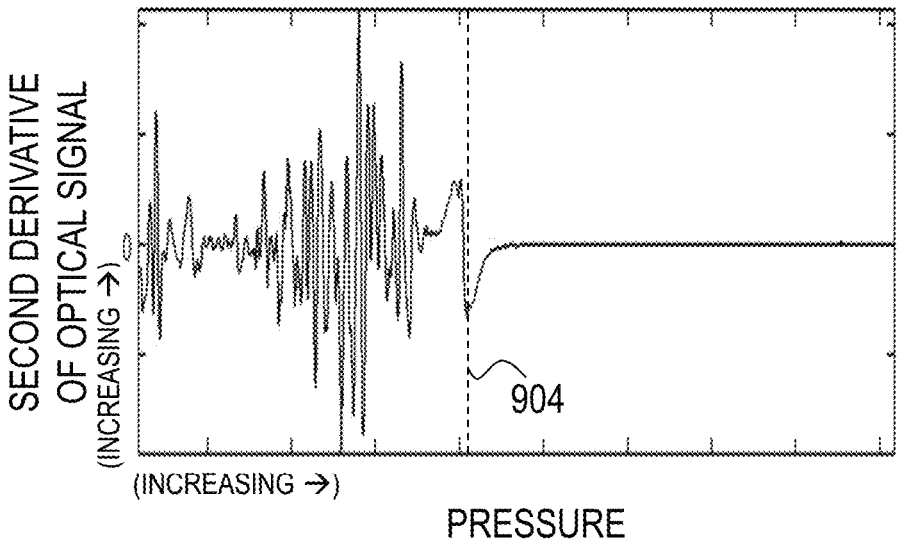
FIG. 9 is a graph depicting an example dataset according to one or more aspects of the present disclosure.

FIGS. 8 and 9 are graphs illustrating an example first-order derivative $$\frac{dT}{dp}$$

and an example second-order derivative $$\frac{d^2T}{dp^2}$$

of the fitted transmittance response $T(p_0)$, respectively, ("FIRST DERIVATIVE OF OPTICAL SIGNAL" and "SECOND DERIVATIVE OF OPTICAL SIGNAL", respectively) as functions of pressure ("PRESSURE") according to one or more aspects of the present disclosure. The example first-order derivative $$\frac{dT}{dp}$$

of FIG. 8 is obtained from the first order terms b of an example fitted transmittance response $T(p_0)$ that is obtained by fitting the quadratic model of Equation (1) to the example measured transmittance response M(p) of FIG. 6 using the least-absolute error criterion and the iterative re-weighted least-squares algorithm. The example second-order derivative $$\frac{d^2T}{dp^2}$$

of FIG. 9 is obtained from two times the second order terms c of an example fitted transmittance response $T(p_0)$ that is obtained by fitting the quadratic model of Equation (1) to the example measured transmittance response M(p) of FIG. 6 using the least-absolute error criterion and the iterative re-weighted least-squares algorithm.

The method (500) comprises obtaining (508) a first energy ratio function $E_1(p_0)$ and a second energy ratio function $E_2(p_0)$ of the first-order derivative $$\frac{dT}{dp}$$

and second-order derivative $$\frac{d^2T}{dp^2}$$

of the fitted transmittance response $T(p_0)$, respectively. The energy ratio functions $E_1(p_0)$, $E_2(p_0)$ may define a ratio of energy within a window between pressure $(p_0-p_\tau)$ and pressure $p_0$ of the first-order and second-order derivatives $$\frac{dT}{dp}, \frac{d^2T}{dp^2}$$

to energy within a window between pressure $p_\tau$ and pressure $(p_0+p_\tau)$ of the first-order and second-order derivatives $$\frac{dT}{dp}, \frac{d^2T}{dp^2},$$

respectively, as shown in Equation (6) below.

$$E_i(p_0) = \frac{\sum_{p=p_0-p_\tau}^{p_0} (x_i(p))^2}{\sum_{p=p_0}^{p_0+p_\tau} (x_i(p))^2}, \qquad \text{Eq. (6)}$$

where

-continued $$x_i(p) = \frac{d^i T}{dp^i}$$

In Equation (6), pressure width $p_\tau$ defines a width of the sliding window that begins or ends at pressure $p_0$. The energy ratio functions $E_1(p_0)$, $E_2(p_0)$ can be used to determine at what pressure the first-order and second-order derivatives $$\frac{dT}{dp}, \frac{d^2T}{dp^2}$$

indicate characteristic changes in the fitted transmittance response $T(p_0)$.

Figure 10:
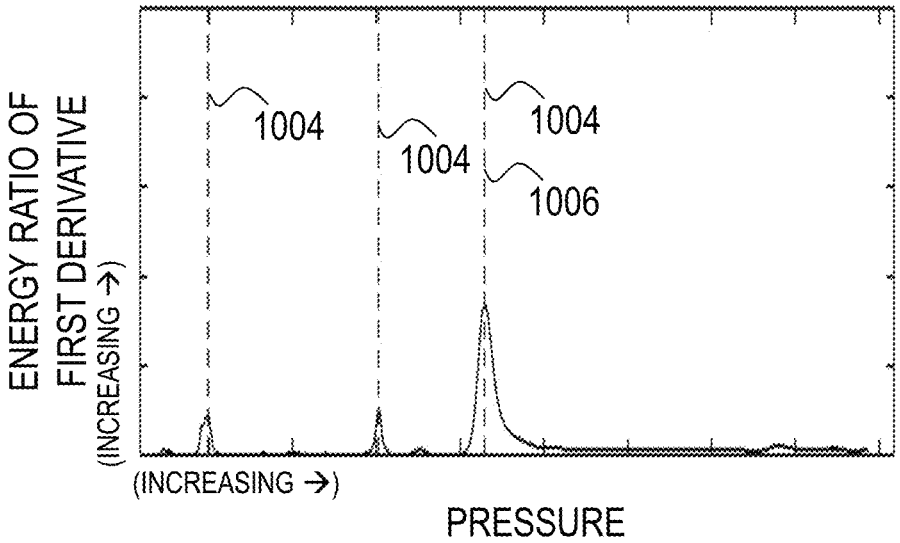
FIG. 10 is a graph depicting an example dataset according to one or more aspects of the present disclosure.
Figure 11:
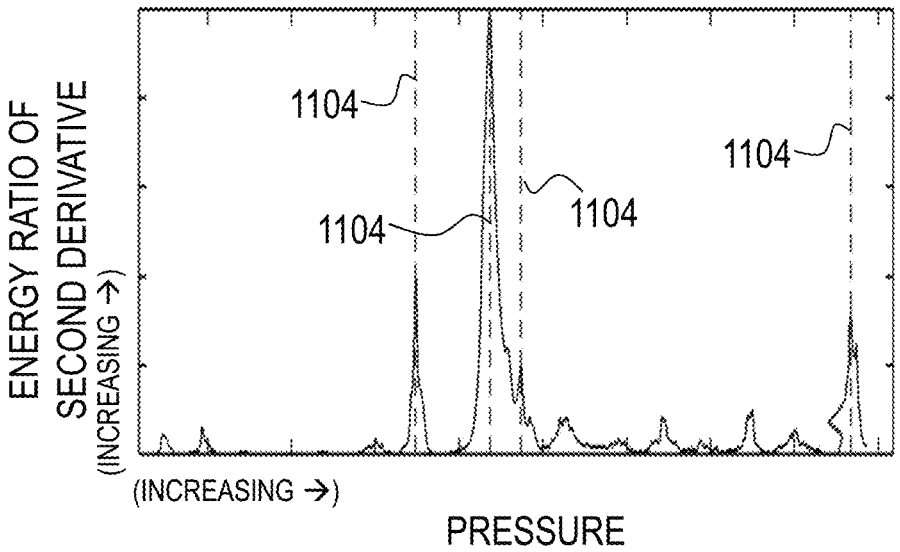
FIG. 11 is a graph depicting an example dataset according to one or more aspects of the present disclosure.

FIGS. 10 and 11 are graphs illustrating an example first energy ratio function $E_1(p_0)$ and an example second energy ratio function $E_2(p_0)$ of the first-order derivative $$\frac{dT}{dp}$$

and second derivative $$\frac{d^2T}{dp^2}$$

of the fitted transmittance response $T(p_0)$, respectively, ("ENERGY RATIO OF FIRST DERIVATIVE" and "ENERGY RATIO OF SECOND DERIVATIVE", respectively) as functions of pressure ("PRESSURE") according to one or more aspects of the present disclosure. The example first energy ratio function $E_1(p_0)$ of FIG. 10 is obtained according to Equation (6) above using the example first-order derivative $$\frac{dT}{dp}$$

of FIG. 8. The example second energy ratio function $E_2(p_0)$ of FIG. 11 is obtained according to Equation (6) above using the example second-order derivative $$\frac{d^2T}{dp^2}$$

of FIG. 9.

The method (500) comprises determining (510) a pressure $P_{ODI}$ of optical density indicator (ODI). The pressure $P_{ODI}$ may be the pressure at the largest inflection point of the fitted transmittance response $T(p_0)$. The pressure $P_{ODI}$, in an example implementation, is the pressure at the highest peak (e.g., greatest positive displacement from the origin, which is a vertical displacement as illustrated in the example graphs) of the first-order derivative $$\frac{dT}{dp}$$

of the fitted transmittance response $T(p_0)$. The pressure $P_{ODI}$ can indicate the pressure at which the fitted transmittance response $T(p_0)$ is changing the most and can identify where the fluid is unambiguously undergoing a phase transition, such as from a gas to a liquid, during depressurization. An example pressure $P_{ODI}$ 804 is shown in the example first-order derivative $$\frac{dT}{dp}$$

of FIG. 8.

In some examples, a peak, such as the peak for the pressure $P_{ODI}$, may be identified using various techniques. As an example, a sliding window may traverse the first-order derivative $$\frac{dT}{dp}$$

of the fitted transmittance response $T(p_0)$. The window may identify a data range, and when the data identified by the window indicates a transition from increasing data to decreasing data, a peak may be identified at the transition point.

In some examples, thresholding may be used in identifying peaks. For example, for a peak to be identified, the value of the first-order derivative $$\frac{dT}{dp}$$

at the transition point exceeds the threshold value. Using thresholding can prevent noise from being unnecessarily considered as a peak.

The threshold value can be determined by a number of methods. In some example implementations, the threshold value can be pre-defined, such as by user input, and can be constant throughout the identification of peaks. In some examples, the threshold value can be dynamic. For example, noise in the measured transmittance response M(p) may be determined by observing the measured transmittance response M(p) before depressurizing the fluid. The threshold value can then be set based on a predefined number of standard deviations of the noise $\sigma_N$ that is observed before depressurization, for example $10\sigma_N$. Once the threshold value is set based on the standard deviation of the noise $\sigma_N$, a peak having a value exceeding the threshold value may be identified, whereas peaks that have a value that do not exceed the threshold are not identified. The value of the first-order derivative $$\frac{dT}{dp}$$

at an identified peak can then be used as a basis for the threshold value, such as some percentage or fraction of the value of the first-order derivative $$\frac{dT}{dp}$$

at that peak, like 10% of the value. At each instance where a peak is identified, the threshold value may be reset if the value of the first-order derivative $$\frac{dT}{dp}$$

at the subsequently identified peak is greater than the value of the first-order derivative $$\frac{dT}{dp}$$

at the peak used to previously set the threshold value, for example. When the window has traversed the first-order derivative $$\frac{dT}{dp}$$

of the fitted transmittance response $T(p_0)$, the identified peaks may be interrogated against the current threshold value to remove from consideration any peaks that were identified before the current threshold value was set and that have values that do not exceed the threshold value. In other examples, the threshold value may remain based on the standard deviation of the noise $\sigma_N$ throughout the identification.

With the one or more peaks identified, the peak having the largest value of the first-order derivative $$\frac{dT}{dp}$$

can be identified by a comparison of the values of the first-order derivative $$\frac{dT}{dp}$$

at the identified peaks. The pressure of the peak having the highest value is identified as the pressure $P_{ODI}$. In other example implementations, a maximum value of the first-order derivative $$\frac{dT}{dp}$$

can be identified, and the pressure at that maximum value can be identified as the pressure $P_{ODI}$.

The method (500) comprises determining (512) a pressure $P_{curv}$ of downward curve. The pressure $P_{curv}$ can identify a point of the fitted transmitted response $T(p_0)$ where the change in the downward slope (from a decreasing pressure perspective) of the fitted transmitted response $T(p_0)$ is locally the most negative. The pressure $P_{curv}$ can be determined by identifying pressures of troughs (e.g., negative displacement from the origin, which is a vertical displacement as illustrated in the example graphs) in the second-order derivative $$\frac{d^2T}{dp^2}$$

of the fitted transmitted response $T(p_0)$ and by identifying the pressure of the trough that is nearest to and greater than the pressure $P_{ODI}$. An example pressure $P_{curv}$ 904 is shown in the example second-order derivative $$\frac{d^2T}{dp^2}$$

of FIG. 9.

In some examples, a trough, such as the trough for the pressure $P_{curv}$, may be identified using various techniques. As an example and similar to identifying peaks as described above, a sliding window may traverse along the second-order derivative $$\frac{d^2T}{dp^2}$$

of the fitted transmittance response $T(p_0)$. The window may identify a data range, and when the data identified by the window indicates a transition from decreasing data to increasing data, a trough may be identified at the transition point. Similar to identifying peaks as described above, thresholding may be used to identify troughs. Threshold values may be determined using techniques described above or using other techniques. In examples where thresholding is used, a trough can be identified when the magnitude of the value of the second-order derivative $$\frac{d^2T}{dp^2}$$

at the transition point of the trough exceeds the magnitude of the threshold value.

The method (500) comprises determining (514) a pressure $P_{init}$ of an initiation point. The pressure $P_{init}$ can indicate a locally largest characteristic change in the fitted transmittance response $T(p_0)$, such as the beginning of a phase change of the fluid as represented by a plunge in the fitted transmittance response $T(p_0)$. The pressure $P_{init}$ can be determined by identifying a group of pressures of peaks of the energy ratio functions $E_1(p_0)$, $E_2(p_0)$. The pressure $P_{init}$ is, in some examples, the lowest pressure of the group of pressures identified from the energy ratio functions $E_1(p_0)$, $E_2(p_0)$ that is greater than the pressure $P_{curv}$. The peaks may be identified from the energy ratio functions $E_1(p_0)$, $E_2(p_0)$ as described above, and thresholding may be used to identify the peaks. Example identified pressures of peaks 1004, 1104 are shown in the example energy ratio functions $E_1(p_0)$, $E_2(p_0)$ of FIGS. 10 and 11, respectively. From these identified pressures of peaks 1004, 1104, the pressure $P_{init}$ 1006 is shown.

The method (500) includes constructing (516) lines based on the pressure $P_{ODI}$ and the pressure $P_{init}$ to obtain a pressure $P_{IS}$ of an intersection point. The lines take the form y=mx+b. A first line intersects the filtered transmittance response $F_T(p_0)$ at pressure $P_{ODI}$ and, hence, is constructed based on the point ($P_{ODI}$, $F_T(P_{ODI})$). The first line is further constructed using the value of the first-order derivative $$\frac{dT}{dp}$$

of the fitted transmittance response $T(p_0)$ at pressure $P_{ODI}$ as the slope $m_{ODI}$. The constant $b_{ODI}$ is determined by rearranging the line equation to obtain $b_{ODI}=F_T(P_{ODI})-(m_{ODI}*P_{ODI})$.

Similarly, a second line intersects the filtered transmittance response $F_T(p_0)$ at pressure $P_{init}$ and, hence, is constructed based on the point ($P_{init}$, $F_T(P_{init})$). The second line is further constructed using the value of the first-order derivative $$\frac{dT}{dp}$$

of the fitted transmittance response $T(p_0)$ at pressure $P_{init}$ as the slope $m_{init}$. The constant $b_{init}$ is determined by rearranging the line equation to obtain $b_{init}=F_T(P_{init})-(m_{init}*P_{init})$.

The pressure $P_{IS}$ is the intersection of the constructed lines. Since the intersection of the first and second lines is to be identified, the pressure $P_{IS}$ at the intersection can be determined as shown in Equations (7) and (8) below.

$$m_{ODI}*P_{IS}+b_{ODI}=m_{init}*P_{IS}+b_{init} \quad \text{Eq. (7)}$$

$$P_{IS}=(b_{init}-b_{ODI})/(m_{ODI}-m_{init}) \quad \text{Eq. (8)}$$

Figure 12:
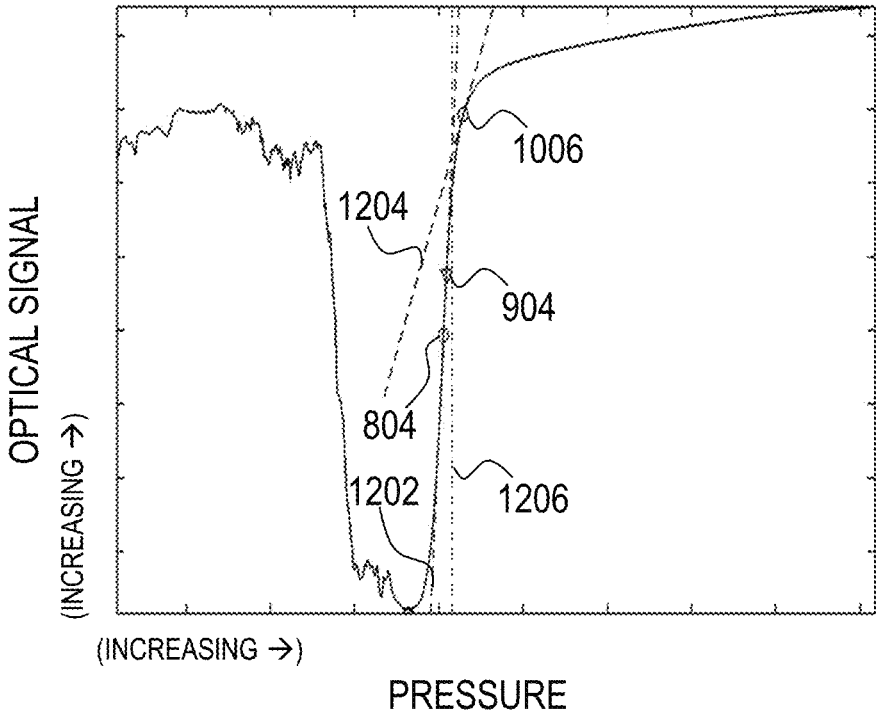
FIG. 12 is a graph depicting an example dataset according to one or more aspects of the present disclosure.

FIG. 12 is a graph illustrating an example measured transmittance response M(p) ("OPTICAL SIGNAL") as a function of pressure ("PRESSURE") according to one or more aspects of the present disclosure. The graph includes the example measured transmittance response M(p) of FIG. 6 with various pressures and lines as determined by the method (500) of FIG. 5 and as described above with respect to FIG. 7-11 according to an example. FIG. 12 shows the example pressure $P_{ODI}$ 804, example pressure $P_{curv}$ 904, and the example pressure $P_{init}$ 1006. An example first line 1202 based on the example pressure $P_{ODI}$ 804 and an example second line 1204 based on the example pressure $P_{init}$ 1006, as constructed (516) according to the method (500), are shown in FIG. 12. The first line 1202 and the second line 1204 intersect at the example pressure $P_{IS}$ 1206.

The method (500) includes estimating (518) an estimated dew point pressure $P_{EST}$. The estimated dew point pressure $P_{EST}$ can be any one or more of the pressure $P_{ODI}$, pressure $P_{curv}$, pressure $P_{init}$, and pressure $P_{IS}$. In some example implementations, the estimated dew point pressure $P_{EST}$ is the pressure $P_{ODI}$. The estimated dew point pressure $P_{EST}$ can be output to an operator to be used for operation decisions. Additionally, the pressures $P_{ODI}$, $P_{init}$, $P_{curv}$, $P_{init}$, and $P_{IS}$ can be output to the operator as an indication of the certainty of the estimated dew point pressure $P_{EST}$. For example, a small range between the pressures $P_{ODI}$ and $P_{init}$ can indicate a high degree of certainty of the estimated dew point pressure $P_{EST}$, whereas a low range between the pressures $P_{ODI}$ and $P_{init}$ can indicate a low degree of certainty of the estimated dew point pressure $P_{EST}$. Operation decisions can be adjusted according to the estimated dew point pressure $P_{EST}$ and any indicated uncertainty.

In view of the entirety of the present disclosure, including the claims and the figures, a person having ordinary skill in the art will readily recognize that the present disclosure introduces an apparatus comprising a processing system comprising a processor and a memory including computer program code, and a method of operating the processing system to: obtain a data response of a fluid as a function of pressure of the fluid; detect an inflection pressure based on the data response; detect a downward curve pressure greater than the inflection pressure based on the data response; detect a characteristic change pressure greater than the downward curve pressure based on the data response; detect an intersection pressure of a first line through the inflection pressure and a second line through the characteristic change pressure; and estimate a dew point pressure of the fluid based on at least one of the inflection pressure, the downward curve pressure, the characteristic change pressure, and the intersection pressure.

Operating the processing system may be to obtain a fitted response as a function of pressure by fitting the data response to a polynomial model. The polynomial model may be at least order two. The fitting may use a least-squares criterion, a least-absolute error criterion, or a combination thereof. The inflection pressure may be detected from a first-order derivative of the fitted response, the downward curve pressure may be detected from a second-order derivative of the fitted response, and the characteristic change pressure may be detected from a first energy ratio function and a second energy ratio function. The first energy ratio function may be a function of a first ratio of a first term to a second term, wherein the first term may be based on a first sliding window, the second term may be based on a second sliding window, the first sliding window may adjoin the second sliding window through the first-order derivative of the fitted response, and the first sliding window may cover a range at pressures lower than the second sliding window. The second energy ratio function may be a function of a second ratio of a third term to a fourth term, wherein the third term may be based on a third sliding window, the fourth term may be based on a fourth sliding window, the third sliding window may adjoin the fourth sliding window through the second-order derivative of the fitted response, and the third sliding window may cover a lower pressure range than the fourth sliding window. The inflection pressure may be detected at a peak with a maximum value in the first-order derivative of the fitted response, the downward curve pressure may be detected at a trough in the second-order derivative of the fitted response that has a pressure greater than and nearest to the inflection pressure, and the characteristic change pressure may be detected at a peak of a group of peaks that has a pressure greater than and nearest to the downward curve pressure, wherein the group of peaks may be collected from peaks of the first energy ratio function and the second energy ratio function. The first line may be constructed using a filtered response of the fitted response at the inflection pressure and the first-order derivative of the fitted response at the inflection pressure, and the second line may be constructed using the filtered response at the characteristic change pressure and the first-order derivative of the fitted response at the characteristic change pressure.

The inflection pressure may be detected from a first-order derivative of a function representative of the data response, the downward curve pressure may be detected from a second-order derivative of the function representative of the data response, and the characteristic change pressure may be detected from a first energy ratio function and a second energy ratio function. The first energy ratio function may be a function of a first ratio of a first term to a second term, wherein the first term may be based on a first sliding window, the second term may be based on a second sliding window, the first sliding window may adjoin the second sliding window through the first-order derivative of the function representative of the data response, and the first sliding window may cover a range at pressures lower than the second sliding window. The second energy ratio function may be a function of a second ratio of a third term to a fourth term, wherein the third term may be based on a third sliding window, the fourth term may be based on a fourth sliding window, the third sliding window may adjoin the fourth sliding window through the second-order derivative of the function representative of the data response, and the third sliding window may cover a lower pressure range than the fourth sliding window. The inflection pressure may be detected at a peak with a maximum value in the first-order derivative of the function representative of the data response, the downward curve pressure may be detected at a trough in the second-order derivative of the function representative of the data response that has a pressure greater than and nearest to the inflection pressure, and the characteristic change pressure may be detected at a peak of a group of peaks that has a pressure greater than and nearest to the downward curve pressure, wherein the group of peaks may be collected from peaks of the first energy ratio function and the second energy ratio function. The first line may be constructed using a filtered response at the inflection pressure and the first-order derivative of the function representative of the data response at the inflection pressure, wherein the filtered response may be based on the data response. The second line may be constructed using the filtered response at the characteristic change pressure and the first-order derivative of the function representative of the data response at the characteristic change pressure.

The first line may be constructed using a de-noised response representative of the data response at the inflection pressure and a first slope determined based on the data response and the inflection pressure, and the second line may be constructed using the de-noised response at the characteristic change pressure and a second slope determined based on the data response and the characteristic change pressure.

The data response as the function of pressure may be an optical transmittance response as a function of pressure.

The estimated dew point pressure may be the inflection pressure, the downward curve pressure, the characteristic change pressure, or the intersection pressure.

The present disclosure also introduces an apparatus comprising a processing system comprising a processor and a memory including computer program code, and a method of operating the processing system to: fit a model to a transmittance response of a fluid as a function of pressure to obtain a fitted response; identify an inflection pressure of the fitted response; identify a downward curve pressure of the fitted response, wherein the downward curve pressure is greater than the inflection pressure; identify a characteristic change pressure of the fitted response, wherein the characteristic change pressure is greater than the downward curve pressure; identify an intersection pressure at an intersection of a first line and a second line, wherein the first line is based on the inflection pressure and the fitted response, and wherein the second line is based on the characteristic change pressure and the fitted response; and estimate a dew point pressure of the fluid based on at least one of the inflection pressure, the downward curve pressure, the characteristic change pressure, and the intersection pressure.

The model may be a polynomial model having an order of at least two.

The inflection pressure may be identified at a peak with a maximum value in a first-order derivative of the fitted response, the downward curve pressure may be identified at a trough in a second-order derivative of the fitted response that has a pressure greater than and nearest to the inflection pressure, and the characteristic change pressure may be identified at a peak of a group of peaks that has a pressure greater than and nearest to the downward curve pressure. The group of peaks may be collected from peaks of a first energy ratio function and a second energy ratio function. The first energy ratio function may be a function of a first ratio of a first term to a second term, wherein the first term may be based on a first sliding window, the second term may be based on a second sliding window, the first sliding window may adjoin the second sliding window through the first-order derivative of the fitted response, and the first sliding window may cover lower pressures than the second sliding window. The second energy ratio function may be a function of a second ratio of a third term to a fourth term, wherein the third term may be based on a third sliding window, the fourth term may be based on a fourth sliding window, the third sliding window may adjoin the fourth sliding window through the second-order derivative of the fitted response, and the third sliding window may cover lower pressures than the fourth sliding window.

The first line may be constructed using a filtered response of the fitted response at the inflection pressure and a first-order derivative of the fitted response at the inflection pressure, and the second line may be constructed using the filtered response at the characteristic change pressure and the first-order derivative of the fitted response at the characteristic change pressure.

The estimated dew point pressure may be the inflection pressure, the downward curve pressure, the characteristic change pressure, or the intersection pressure.

The present disclosure also introduces an apparatus comprising a processing system comprising a processor and a memory including computer program code, and a method of operating the processing system to: fit a model to a transmittance response of a fluid as a function of pressure to obtain a fitted response; obtain a filtered response, a first-order derivative, and a second-order derivative from the fitted response; obtain a first energy ratio function and a second energy ratio function based on the first-order derivative and the second-order derivative, respectively, wherein the first energy ratio function and the second energy ratio function are respective ratios of a first term to a second term, the first term is based on a first sliding window along the respective first-order derivative or the second-order derivative, the second term is based on a second sliding window along the respective first-order derivative or the second-order derivative, and the first sliding window is adjacent to and along pressures less than the second sliding window; detect an inflection pressure at a maximum peak of the first-order derivative; detect a downward curve pressure at a trough of the second-order derivative nearest to and greater than the inflection pressure; detect a characteristic change pressure from a collection of pressures nearest to and greater than the downward curve pressure, wherein the collection of pressures comprises first identified pressures at respective peaks of the first energy ratio function and second identified pressures at respective peaks of the second energy ratio function; detect an intersection pressure at an intersection of a first line and a second line, wherein the first line is based on the fitted response at the inflection pressure and the first-order derivative at the inflection pressure, and the second line is based on the fitted response at the characteristic change pressure and the first-order derivative at the characteristic change pressure; and estimate a dew point pressure of the fluid based on at least one of the inflection pressure, the downward curve pressure, the characteristic change pressure, and the intersection pressure.

The estimated dew point pressure may be the inflection pressure, the downward curve pressure, the characteristic change pressure, or the intersection pressure.

The present disclosure also introduces an apparatus comprising a processing system comprising a processor and a memory including computer program code, and a method of operating the processing system to: obtain a data response of a fluid as a function of pressure of the fluid; and estimate a dew point pressure of the fluid by detecting an inflection pressure of a function representative of the data response, wherein the estimated dew point pressure is the inflection pressure.

Operating the processing system may also be to obtain a fitted response as a function of pressure by fitting the data response to a polynomial model, the fitted response being the function representative of the data response.

Detecting the inflection pressure may include identifying the inflection pressure having a value of a first-order derivative of the function representative of the data response above a threshold.

Detecting the inflection pressure may include detecting the inflection pressure with a largest value of a first-order derivative of the function representative of the data response.

The present disclosure also introduces an apparatus comprising a processing system comprising a processor and a memory including computer program code, and a method of operating the processing system to: obtain a data response of a fluid as a function of pressure of the fluid; detect an inflection pressure of a function representative of the data response; and estimate a dew point pressure of the fluid by detecting a downward curve pressure of the function representative of the data response, wherein the downward curve pressure is greater than the inflection pressure, wherein the estimated dew point pressure is the downward curve pressure.

Detecting the downward curve pressure may include identifying the downward curve pressure at a trough in a second-order derivative of the function representative of the data response that is nearest the inflection pressure.

Detecting the downward curve pressure may include identifying the downward curve pressure having a magnitude of a value of a second-order derivative of the function representative of the data response exceeding a threshold.

The present disclosure also introduces an apparatus comprising a processing system comprising a processor and a memory including computer program code, and a method of operating the processing system to: obtain a data response of a fluid as a function of pressure of the fluid; detect an inflection pressure of a function representative of the data response; detect a downward curve pressure of the function representative of the data response, wherein the downward curve pressure is greater than the inflection pressure; and estimate a dew point pressure of the fluid by detecting a characteristic change pressure of the function representative of the data response, wherein the characteristic change pressure is greater than the downward curve pressure, wherein the estimated dew point pressure is the characteristic change pressure.

The characteristic change pressure may be identified at a peak of a group of peaks that has a pressure greater than and nearest to the downward curve pressure, wherein the group of peaks may be collected from peaks of a first energy ratio function and a second energy ratio function. The first energy ratio function may be a function of a first ratio of a first term to a second term, wherein the first term may be based on a first sliding window, the second term may be based on a second sliding window, the first sliding window may adjoin the second sliding window through a first-order derivative of the function representative of the data response, and the first sliding window may cover lower pressures than the second sliding window. The second energy ratio function may be a function of a second ratio of a third term to a fourth term, wherein the third term may be based on a third sliding window, the fourth term may be based on a fourth sliding window, the third sliding window may adjoin the fourth sliding window through a second-order derivative of the function representative of the data response, and the third sliding window may cover lower pressures than the fourth sliding window.

The present disclosure also introduces an apparatus comprising a processing system comprising a processor and a memory including computer program code, and a method of operating the processing system to: obtain a data response of a fluid as a function of pressure of the fluid; detect an inflection pressure of a function representative of the data response; detect a downward curve pressure of the function representative of the data response, wherein the downward curve pressure is greater than the inflection pressure; detect a characteristic change pressure of the function representative of the data response, wherein the characteristic change pressure is greater than the downward curve pressure; and estimate a dew point pressure of the fluid by detecting an intersection pressure of a first line through the inflection pressure in the function representative of the data response and a second line through the characteristic change pressure in the function representative of the data response, wherein the estimated dew point pressure is the intersection pressure.

The first line may be constructed using a filtered response at the inflection pressure and a first-order derivative of the function representative of the data response at the inflection pressure, wherein the filtered response may be based on the data response. The second line may be constructed using the filtered response at the characteristic change pressure and the first-order derivative of the function representative of the data response at the characteristic change pressure.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. A method comprising:

obtaining formation fluid from a wellbore with a downhole tool;

depressurizing the formation fluid in the downhole tool;

obtaining optical transmittance data from a phase transition cell with respect to pressure, representing a transmittance response of the reservoir fluid;

operating a processing system comprising a processor and a memory including computer program code to predict a dew point pressure of a fluid in real-time and in situ at the wellsite, wherein operating the processing system comprises:

fitting a model to the transmittance response of the reservoir fluid as a function of pressure to obtain a fitted response;

obtaining a filtered response, a first-order derivative, and a second-order derivative from the fitted response;

obtaining a first energy ratio function and a second energy ratio function based on the first-order derivative and the second-order derivative, respectively, wherein:

the first energy ratio function and the second energy ratio function are respective ratios of a first term to a second term;

the first term is based on a first sliding window along the respective first-order derivative or the second-order derivative;

the second term is based on a second sliding window along the respective first-order derivative or the second-order derivative; and the first sliding window is adjacent to and along pressures less than the second sliding window;

detecting an inflection pressure at a maximum peak of the first-order derivative;

detecting a downward curve pressure at a trough of the second-order derivative nearest to and greater than the inflection pressure;

detecting a characteristic change pressure from a collection of pressures nearest to and greater than the downward curve pressure, wherein the collection of pressures comprises first identified pressures at respective peaks of the first energy ratio function and second identified pressures at respective peaks of the second energy ratio function;

detecting an intersection pressure at an intersection of a first line and a second line, wherein:

the first line is based on the fitted response at the inflection pressure and the first-order derivative at the inflection pressure; and the second line is based on the fitted response at the characteristic change pressure and the first-order derivative at the characteristic change pressure; and estimating a dew point pressure of the fluid based on at least one of the inflection pressure, the downward curve pressure, the characteristic change pressure, and the intersection pressure; and using the estimated dew point pressure to direct one or more operation decisions of the wellbore, wherein the one or more operation decisions comprise adjusting a pressure the wellbore is maintained at during production based, at least in part, on the estimated dew point pressure.

2. The method of claim 1 wherein the estimated dew point pressure is the inflection pressure.

3. The method of claim 1 wherein the estimated dew point pressure is the downward curve pressure.

4. The method of claim 1 wherein the estimated dew point pressure is the characteristic change pressure.

5. The method of claim 1 wherein the estimated dew point pressure is the intersection pressure.

6. A method comprising:

obtaining formation fluid from a wellbore with a downhole tool;

depressurizing the formation fluid in the downhole tool;

obtaining data of an optical transmittance response as a function of pressure of the formation fluid using a phase transition cell;

operating a processing system comprising a processor and a memory including computer program code to predict a dew point pressure of a fluid in real-time and in situ at the wellsite, wherein operating the processing system comprises:

with the processor using the data to determine a data response of a fluid as a function of pressure of the fluid;

detecting an inflection pressure of a function representative of the data response;

detecting a downward curve pressure of the function representative of the data response, wherein the downward curve pressure is greater than the inflection pressure;

detecting a characteristic change pressure of the function representative of the data response, wherein the characteristic change pressure is greater than the downward curve pressure; and estimating a dew point pressure of the fluid by detecting an intersection pressure of a first line through the inflection pressure in the function representative of the data response and a second line through the characteristic change pressure in the function representative of the data response, wherein the estimated dew point pressure is the intersection pressure; and using the estimated dew point pressure to direct one or more operation decisions of the wellbore, wherein the one or more operation decisions comprise adjusting a pressure the wellbore is maintained at during production based, at least in part, on the estimated dew point pressure.

7. The method of claim 6 wherein:

the first line is constructed using a filtered response at the inflection pressure and a first-order derivative of the function representative of the data response at the inflection pressure;

the filtered response is based on the data response; and the second line is constructed using the filtered response at the characteristic change pressure and the first-order derivative of the function representative of the data response at the characteristic change pressure.

8. A method comprising:

obtaining formation fluid from a wellbore with a downhole tool;

depressurizing the formation fluid in the downhole tool;

obtaining data of an optical transmittance response as a function of pressure of the formation fluid using a phase transition cell;

operating a processing system comprising a processor and a memory including computer program code to predict a dew point pressure of a fluid in real-time and in situ at the wellsite, wherein operating the processing system comprises:

with the processor using the data to determine a data response of a fluid as a function of pressure of the fluid;

detecting an inflection pressure of a function representative of the data response; and estimating a dew point pressure of the fluid based on at least the inflection pressure; and using the estimated dew point pressure to direct one or more operation decisions of the wellbore, wherein the one or more operation decisions comprise adjusting a pressure the wellbore is maintained at during production based, at least in part, on the estimated dew point pressure to avoid condensate banking.

9. The method of claim 8 wherein operating the processing system further comprises obtaining a fitted response as a function of pressure by fitting the data response to a polynomial model, and wherein the fitted response is the function representative of the data response.

10. The method of claim 8 wherein detecting the inflection pressure includes identifying the inflection pressure having a value of a first-order derivative of the function representative of the data response above a threshold.

11. The method of claim 8 wherein detecting the inflection pressure includes detecting the inflection pressure with a largest value of a first-order derivative of the function representative of the data response.

12. The method of claim 8 wherein operating the processing system further comprises detecting a downward curve pressure of the function representative of the data response, wherein the downward curve pressure is greater than the inflection pressure, and wherein the estimated dew point pressure is the downward curve pressure.

13. The method of claim 12 wherein detecting the downward curve pressure includes identifying the downward curve pressure at a trough in a second-order derivative of the function representative of the data response that is nearest the inflection pressure.

14. The method of claim 12 wherein detecting the downward curve pressure includes identifying the downward curve pressure having a magnitude of a value of a second-order derivative of the function representative of the data response exceeding a threshold.

15. The method of claim 8 wherein operating the processing system further comprises:

detecting a downward curve pressure of the function representative of the data response, wherein the downward curve pressure is greater than the inflection pressure; and detecting a characteristic change pressure of the function representative of the data response, wherein the characteristic change pressure is greater than the downward curve pressure, and wherein the estimated dew point pressure is the characteristic change pressure.

16. The method of claim 15 wherein:

the characteristic change pressure is identified at a peak of a group of peaks that has a pressure greater than and nearest to the downward curve pressure;

the group of peaks is collected from peaks of a first energy ratio function and a second energy ratio function;

the first energy ratio function is a function of a first ratio of a first term to a second term;

the first term is based on a first sliding window;

the second term is based on a second sliding window;

the first sliding window adjoins the second sliding window through a first-order derivative of the function representative of the data response;

the first sliding window covers lower pressures than the second sliding window;

the second energy ratio function is a function of a second ratio of a third term to a fourth term;

the third term is based on a third sliding window;

the fourth term is based on a fourth sliding window;

the third sliding window adjoins the fourth sliding window through a second-order derivative of the function representative of the data response; and the third sliding window covers lower pressures than the fourth sliding window.

17. The method of claim 8 wherein operating the processing system further comprises:

detecting a downward curve pressure of the function representative of the data response; and detecting a characteristic change pressure of the function representative of the data response; wherein:

the downward curve pressure is greater than the inflection pressure;

the characteristic change pressure is greater than the downward curve pressure; and the estimated dew point pressure is the inflection pressure, the downward curve pressure, or the characteristic change pressure.

18. The method of claim 17 wherein operating the processing system further comprises obtaining a fitted response as a function of pressure by fitting the data response to a polynomial model, and wherein the fitted response is the function representative of the data response.

19. The method of claim 18 wherein:

detecting the inflection pressure includes identifying the inflection pressure having a value of a first-order derivative of the function representative of the data response above a threshold;

detecting the downward curve pressure includes identifying the downward curve pressure at a trough in a second-order derivative of the function representative of the data response that is nearest the inflection pressure;

the characteristic change pressure is identified at a peak of a group of peaks that has a pressure greater than and nearest to the downward curve pressure;

the group of peaks is collected from peaks of a first energy ratio function and a second energy ratio function;

the first energy ratio function is a function of a first ratio of a first term to a second term;

the first term is based on a first sliding window;

the second term is based on a second sliding window;

the first sliding window adjoins the second sliding window through a first-order derivative of the function representative of the data response;

the first sliding window covers lower pressures than the second sliding window;

the second energy ratio function is a function of a second ratio of a third term to a fourth term;

the third term is based on a third sliding window;

the fourth term is based on a fourth sliding window;

the third sliding window adjoins the fourth sliding window through a second-order derivative of the function representative of the data response; and the third sliding window covers lower pressures than the fourth sliding window.

* * * * *